US008511327B2

(12) United States Patent
Sun et al.

(10) Patent No.: US 8,511,327 B2
(45) Date of Patent: Aug. 20, 2013

(54) ANTI-WIND ECCENTRIC UMBRELLA

(76) Inventors: Min Li Sun, Shenzhen (CN); Jin Yang, Shenzhen (CN)

( * ) Notice: Subject to any disclaimer, the term of this patent is extended or adjusted under 35 U.S.C. 154(b) by 0 days.

(21) Appl. No.: 13/485,620

(22) Filed: May 31, 2012

(65) Prior Publication Data

US 2013/0042897 A1 Feb. 21, 2013

(30) Foreign Application Priority Data

Aug. 15, 2011 (CN) ..... 2011 2 0295153 U

(51) Int. Cl.
*A45B 19/12* (2006.01)
*A45B 23/00* (2006.01)

(52) U.S. Cl.
USPC ..... 135/20.1; 135/25.2; 135/27

(58) Field of Classification Search
USPC ..... 135/20.1, 25.2
See application file for complete search history.

(56) References Cited

U.S. PATENT DOCUMENTS 2,948,289 A * 8/1960 Owczarek ..... 135/20.1
3,042,055 A * 7/1962 Bogdan ..... 135/20.1
5,263,505 A * 11/1993 Yeom ..... 135/20.1
5,505,221 A * 4/1996 Gao ..... 135/20.1
6,230,727 B1 * 5/2001 Chen ..... 135/98
6,354,315 B1 * 3/2002 Liu ..... 135/98
6,401,735 B1 * 6/2002 Chou ..... 135/20.1
6,694,993 B2 * 2/2004 Chou ..... 135/98
2004/0163691 A1 * 8/2004 Ma ..... 135/25.2
2006/0090781 A1 * 5/2006 Lisciandro et al. ..... 135/20.1
2009/0308419 A1 * 12/2009 You ..... 135/20.1

FOREIGN PATENT DOCUMENTS

CN 20072122950 U 7/2008

* cited by examiner

*Primary Examiner* — Noah Chandler Hawk
(74) *Attorney, Agent, or Firm* — Schmeiser, Olsen & Watts, LLP

(57) ABSTRACT

The invention provides an anti-wind eccentric umbrella, with a shaft, a framework, an upper ring, a lower ring and a canopy, in which the framework is composed of ribs, stretchers and a main frame. The two ends on one side of a main frame that is cross-hinged by a first main brace and a second main brace through a main frame hinge axis are respectively hinged with the upper ring and the lower ring. The anti-wind eccentric umbrella has a rib vacant position and the rib vacant position and the ribs are distributed in 360°. The main frame is on the rib vacant position, the top notch is hinged with an auxiliary rib, the runner is hinged with an auxiliary stretcher and the auxiliary stretcher is at the rib vacant position at the outer side of that occupied by the main frame.

5 Claims, 4 Drawing Sheets

ANTI-WIND ECCENTRIC UMBRELLA

FIELD OF THE INVENTION

The present utility model invention relates to an anti-wind eccentric umbrella against sun, rain and snow.

BACKGROUND OF THE INVENTION

The eccentric umbrella in the prior art disclosed in the patent CN200720122950.7 comprises a shaft, a framework and a canopy, in which the shaft passes though a runner, one end of a rib forming the framework is hinged on an upper ring. One end of a stretcher is hinged on the rib and the other end is hinged on a lower ring. The ribs and stretchers are distributed in 360°. The canopy is fixed on the framework and a ferrule. Between the shaft and the runner is cooperatively disposed with springs to guide the umbrella or lock the opened umbrella. A top notch is fixed on the top of the shaft. One side of the main frame formed by crossed straight braces is respectively hinged with the upper and the lower rings and the other side is respectively hinged with the top notch and the runner. An auxiliary brace forming an auxiliary frame is hinged with the top notch, the runner and the ferrule. The eccentric umbrella disclosed in the patent CN200720122950.7 has structure and reliability problems. In addition, it also has poor anti-wind property, and thus it is necessary to make an improvement.

SUMMARY OF THE INVENTION

In view of the above-described problems, it is one objective of the present utility model invention to overcome the problems in the prior art by providing an anti-wind eccentric umbrella.

An anti-wind eccentric umbrella, in accordance with the present utility model invention, comprises a shaft, a framework, an upper ring, a lower ring and a canopy, in which the framework is composed of ribs and stretchers, the shaft passes though a runner, one end of the rib forming the framework is hinged on the upper ring, one end of the stretcher is hinged on the rib and the other end is hinged on the lower ring, and the canopy is fixed on the framework. Between the shaft and the runner is cooperatively disposed with springs to guide the umbrella or lock the opened umbrella. A top notch is fixed on the top of the shaft. The two ends on one side of a main frame that is cross-hinged by a first main brace and a second main brace through a main frame hinge axis are respectively hinged with the upper ring and the lower ring. The end on the other side of the first main brace that is hinged on the upper ring is hinged with the runner. The end on the other side of the second main brace that is hinged on the lower ring is hinged with the top notch. The anti-wind eccentric umbrella comprises a rib vacant position. The rib vacant position and the ribs are distributed in 360°. The main frame formed by the first main brace and the second main brace is at the rib vacant position. Meanwhile, the top notch is hinged with an auxiliary rib. The runner is hinged with an auxiliary stretcher. The auxiliary stretcher is also at the rib vacant position at the outer side of that occupied by the main frame.

In the prior art, the first main brace and the second main brace are at the rib vacant position through the main frame, the top notch is hinged with an auxiliary rib, the runner is hinged with an auxiliary stretcher, and the auxiliary stretcher and the auxiliary rib are hinged with each other. The auxiliary rib is also at the rib vacant position at the outer side of that occupied by the main frame. Compared with the eccentric umbrella in the prior art, the anti-wind eccentric umbrella provided by the utility model invention has a more stable structure and in particular the capacity against wind is improved. In addition, there is no big difference on the shaft structure between the anti-wind eccentric umbrella and ordinary umbrellas. The manual opening-closing unit, the semi-automatic opening-closing unit and full-automatic opening-closing unit in the prior art can also be used. According to the above description, the objective of the utility model invention is achieved.

As a further improvement, the anti-wind eccentric umbrella also comprises two intensified braces and one end of the intensified brace is hinged on the top notch and the other end is hinged on two ribs adjacent to the top notch. Such structure helps to enhance the structural strength of the anti-wind eccentric umbrella.

As a further improvement, the top notch is sewed on the canopy, which also helps to enhance the structural strength and stability of the anti-wind eccentric umbrella.

As a further improvement, the hinged point formed by the intensified braces and the ribs is the nearest point to the top notch. Such structure has the optimal structural stability.

As a further improvement, the anti-wind eccentric umbrella also comprises auxiliary intensified braces and one end of the auxiliary intensified brace is hinged on the intensified brace and the other end is hinged on the runner. Such structure further enhances the structure of the anti-wind eccentric umbrella.

As a further improvement, the auxiliary stretchers and the auxiliary ribs are disposed with weight blocks, which help to make the umbrella's centre of gravity on or close to the shaft. Users will feel comfortable when using the anti-wind eccentric umbrella.

Figure 1:
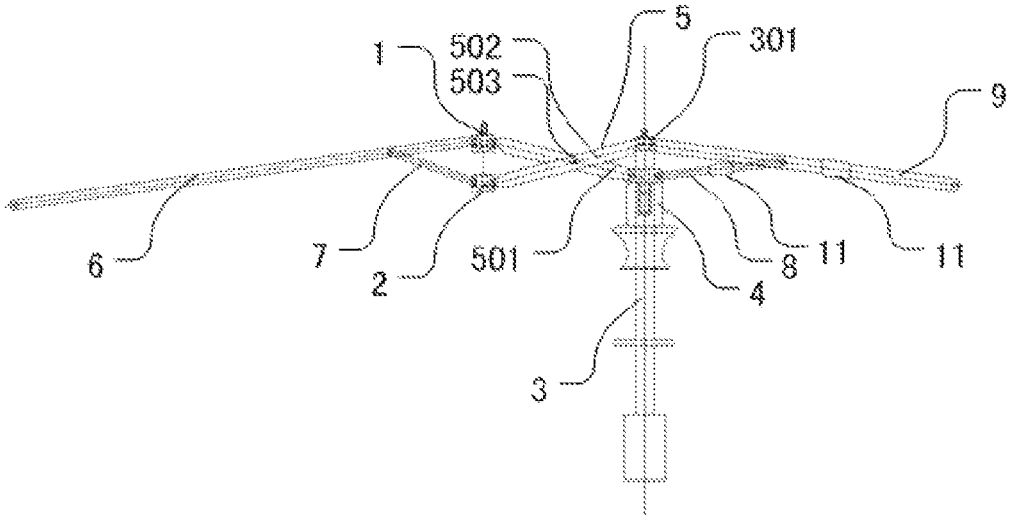
FIG. 1 is a front view of an anti-wind eccentric umbrella provided by the preferred embodiment 1 of the present utility model invention.

As shown in the drawings, the anti-wind eccentric umbrella provided by the utility model invention comprises: an upper ring 1, a lower ring 2, a shaft 3, a top notch 301, a runner 4, a main frame 5, a first main brace 501, a second main brace 502, a main frame hinge axis 503, ribs 6, upper ribs 601, middle ribs 602, lower ribs 603, stretchers 7, an auxiliary stretcher 8, auxiliary ribs 9, upper auxiliary ribs 901, middle auxiliary ribs 902, lower auxiliary ribs 903, a canopy 10, weight blocks 11, intensified braces 12 and auxiliary intensified braces 13.

DETAILED DESCRIPTION OF THE EMBODIMENTS

The present utility model invention is explained in further detail below with reference to the preferred embodiments and attached drawings.

Embodiment 1

Figure 2:
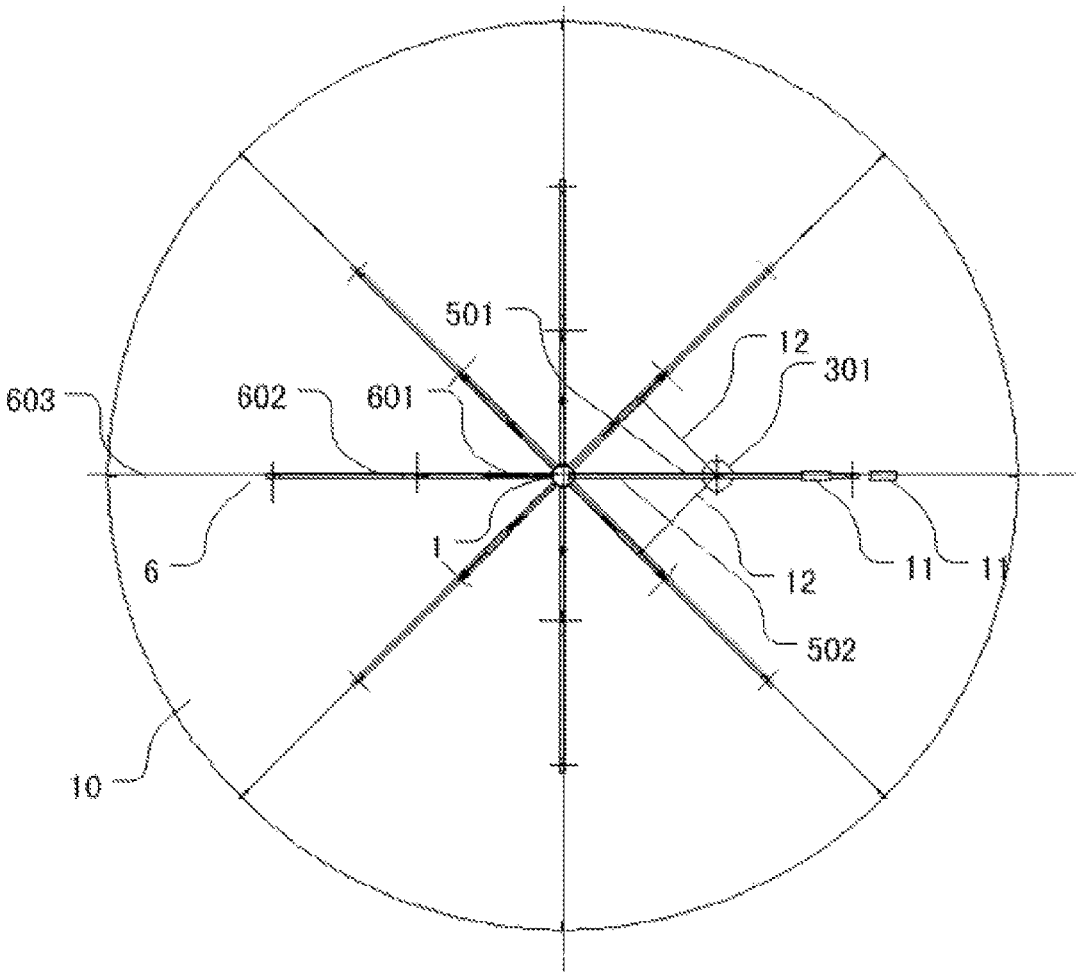
FIG. 2 is a top view of the anti-wind eccentric umbrella provided by the preferred embodiment 1 of the present utility model invention.

As shown in FIGS. 1 and 2, an anti-wind eccentric umbrella, in accordance with the present utility model invention, comprises a shaft 3, a framework, an upper ring 1, a lower ring 2 and a canopy 10, in which the framework are composed of ribs 6 and stretchers 7, the shaft 3 passes through a runner 4, one end of the rib 6 is hinged on the upper ring 1, one end of the stretcher 7 is hinged on the rib 6 and the other end is hinged on the lower ring 2, the canopy 10 is fixed on the framework, between the shaft 3 and the runner 4 is cooperatively disposed with springs to guide the umbrella or lock the opened umbrella, and a top notch 301 is fixed on the top of the shaft 3. The two ends on one side of a main frame 5 that is cross-hinged by a first main brace 501 and a second main brace 502 through a main frame hinge axis 503 are respectively hinged with the upper ring and the lower ring. The end on the other side of the first main brace 501 that is hinged on the upper ring 1 is hinged with the runner 4. The end on the other side of the second main brace 502 that is hinged on the lower ring 2 is hinged with the top notch 301. The anti-wind eccentric umbrella comprises a rib vacant position. The rib vacant position and the ribs 6 are distributed in 360°. The main frame 5 formed by the first main brace 501 and the second main brace 502 is at the rib vacant position. Meanwhile, the top notch 301 is hinged with an auxiliary rib 9. The runner 4 is hinged with an auxiliary stretcher 8. The auxiliary stretcher 8 and the auxiliary rib 9 are hinged with each other. The auxiliary stretcher 8 is also at the rib vacant position at the outer side of that occupied by the main frame 5.

Figure 3:
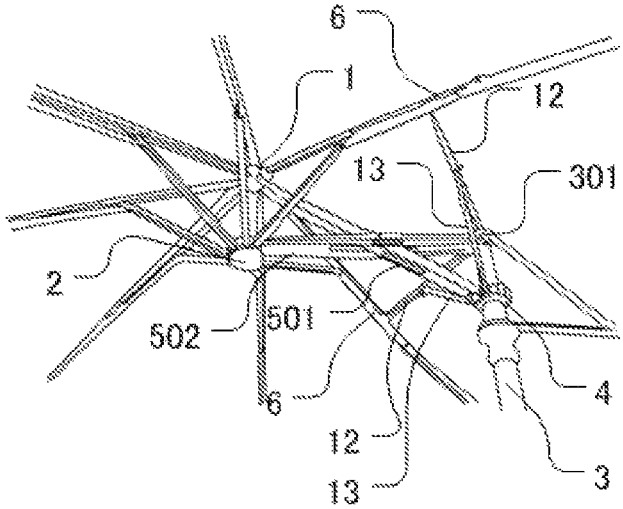
FIG. 3 is a three-dimensional diagram of an intensified brace of the anti-wind eccentric umbrella provided by the preferred embodiment 1 of the present utility model invention.

In this preferred embodiment, as shown in FIGS. 1 and 3, the anti-wind eccentric umbrella also comprises two intensified braces 12. One end of the intensified brace 12 is hinged on the top notch 301 and the other end is hinged on the two ribs 6 adjacent to the top notch. The hinged point formed by the intensified braces 12 and the ribs 6 is the nearest point from the ribs 6 to the top notch 301.

In this preferred embodiment, as shown in FIGS. 1 and 3, the anti-wind eccentric umbrella also comprises auxiliary intensified braces 13. One end of the auxiliary intensified brace 13 is hinged on the intensified brace 12 and the other end is hinged on the runner 4.

In this preferred embodiment, the auxiliary stretcher 8 and the auxiliary rib 9 are disposed with weight blocks 11.

In this preferred embodiment, the top notch 301 is sewed on the canopy 10.

Embodiment 2

Figure 4:
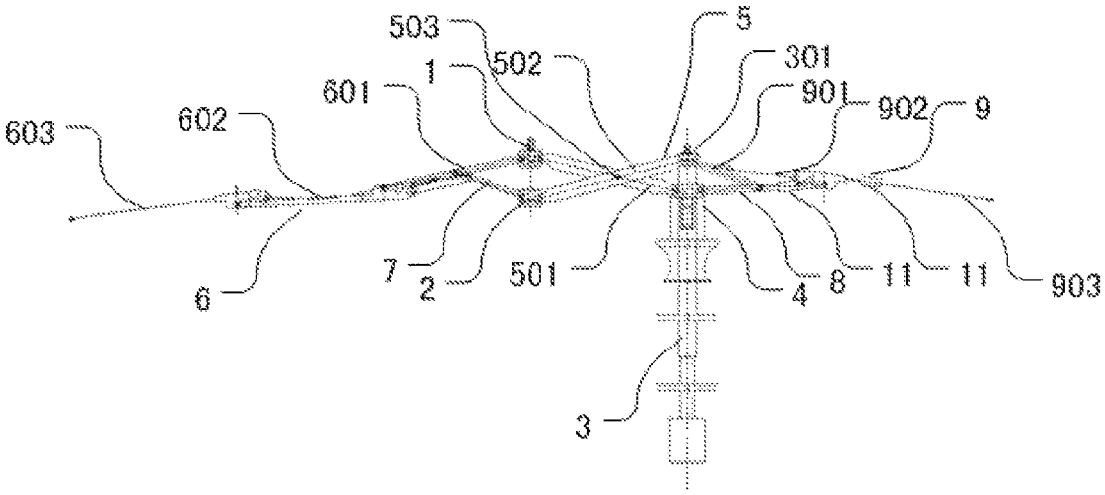
FIG. 4 is a front view of an anti-wind eccentric umbrella provided by the preferred embodiment 2 of the present utility model invention.

As shown in FIGS. 3 and 4, the difference between an anti-wind eccentric umbrella provided in this example with that provided in the example 1 is that the auxiliary rib 9 is composed of an upper auxiliary rib 901, a middle auxiliary rib 902 and a lower auxiliary rib 903, in which one end of the middle auxiliary rib 902 is hinged on the upper auxiliary rib 901 and the other end is hinged on the end of the lower auxiliary rib 903. This structure provided in this example is suitable for foldable eccentric umbrellas.

In summary, an anti-wind eccentric umbrella provided by the present utility model invention comprises a shaft, a framework, an upper ring, a lower ring and a canopy, in which the framework are composed of ribs, stretchers and a main frame. The two ends on one side of the main frame that is cross-hinged by a first main brace and a second main brace through the main frame hinge axis are respectively hinged with an upper ring and a lower ring. The anti-wind eccentric umbrella comprises a rib vacant position. The rib vacant position and the ribs are distributed in 360°. The main frame is on the rib vacant position. The top notch is hinged with an auxiliary rib. The runner is hinged with an auxiliary stretcher. The auxiliary stretcher is at the rib vacant position at the outer side of that occupied by the main frame. The present utility model invention solves the structural problem and poor stability problem that are present in the prior art.

The aforementioned embodiments are the preferred embodiments of the present utility model invention and the protection scope is not limited to this. All changes and modifications made by those skilled in the related art are deemed to be within the applied scope of the utility model invention. Thereby the protection scope of the utility model invention shall be based on that described in the claims.

The invention claimed is:

1. An anti-wind eccentric umbrella, comprising:

a shaft, a framework, an upper ring, a lower ring and a canopy, the framework is composed of ribs and stretchers, the shaft passes through a runner, one end of the rib forming the framework is hinged on the upper ring, one end of the stretcher is hinged on the rib and the other end is hinged on the lower ring, and the canopy is fixed on the framework, a top notch is fixed on the top of the shaft, the two ends on one side of a main frame that is cross-hinged by a first main brace and a second main brace through a main frame hinge axis are respectively hinged with the upper ring and the lower ring, the end on the other side of the first main brace that is hinged on the upper ring is hinged with the runner, the end on the other side of the second main brace that is hinged on the lower ring is hinged with the top notch, wherein the anti-wind eccentric umbrella comprises a rib vacant position, the rib vacant position and the ribs are distributed in 360°, the main frame formed by the first main brace and the second main brace is at the rib vacant position, the top notch is hinged with an auxiliary rib, the runner is hinged with an auxiliary stretcher, and the auxiliary stretcher is also at the rib vacant position at the outer side of that occupied by the main frame, wherein it also comprises two intensified braces and one end of the intensified brace is hinged on the top notch and the other end is hinged on two ribs adjacent to the top notch.

2. The anti-wind eccentric umbrella according to claim 1, wherein the hinged point formed by the intensified braces and the ribs is the nearest point to the top notch.

3. The anti-wind eccentric umbrella according to claim 1, wherein it also comprises auxiliary intensified braces and one end of the auxiliary intensified brace is hinged on the intensified brace and the other end is hinged on the runner.

4. The anti-wind eccentric umbrella according to claim 1, wherein the auxiliary stretchers and the auxiliary ribs are disposed with weight blocks.

5. The anti-wind eccentric umbrella according to claim 1, wherein the auxiliary rib is composed of an upper auxiliary rib, a middle auxiliary rib and a lower auxiliary rib, in which one end of the middle auxiliary rib is hinged on the upper auxiliary rib and the other end is hinged on the end of the lower auxiliary rib.

* * * * *